US005727118A

United States Patent [19]

Roussel et al.

[11] Patent Number: 5,727,118

[45] Date of Patent: Mar. 10, 1998

[54] ELECTRIC BOILER FOR HEAT-TRANSFER LIQUID CIRCULATING IN AN OPEN OR CLOSED CIRCUIT

[75] Inventors: Claude Roussel, Echirolles; Fabrice Chopard, Saint Martin d'Heres, both of France

[73] Assignee: Vicarb, France

[21] Appl. No.: 491,932

[22] PCT Filed: Nov. 25, 1994

[86] PCT No.: PCT/FR94/01377

§ 371 Date: Jul. 17, 1995

§ 102(e) Date: Jul. 17, 1995

[87] PCT Pub. No.: WO95/14893

PCT Pub. Date: Jun. 1, 1995

[30] Foreign Application Priority Data

Nov. 25, 1993 [FR] France ..... 93 14351

[51] Int. Cl.[6] ..... F24H 1/10

[52] U.S. Cl. ..... 392/494; 392/484

[58] Field of Search ..... 392/494, 491, 392/492, 493, 479, 489, 485, 452

[56] References Cited

FOREIGN PATENT DOCUMENTS

| | | |
|---|---|---|
| 0014066 | 1/1980 | European Pat. Off. . |
| 284120 | 9/1988 | European Pat. Off. . |
| 9320389 | 10/1993 | WIPO . |

*Primary Examiner*—Tu B. Hoang

*Attorney, Agent, or Firm*—Wall Marjama & Bilinski

[57] ABSTRACT

Electric boiler for heat-transfer liquid (FC) comprising a set of plates (P) having corrugations on both their faces, and which include, in their corners, openings (3, 4, 5, 6) allowing circulation of fluid. Said assembly consists of at least one module comprising two stamped plates (P), the corrugations of which are in the same sense on both their faces between which at least one heater block (I) is inserted, within which heater block a resistance element (R) is embedded, being in the form of a block which also includes orifices (3, 4, 5, 6) as well as herringbone corrugations on both its faces (A) and (B).

6 Claims, 4 Drawing Sheets

P
4
3
I
5
6
J
R

ELECTRIC BOILER FOR HEAT-TRANSFER LIQUID CIRCULATING IN AN OPEN OR CLOSED CIRCUIT

BACKGROUND OF THE INVENTION

The present invention relates to a novel type of boiler making it possible to raise a heat-transfer liquid to a predetermined temperature.

It relates more particularly to a novel type of electric boiler making it possible to ensure production of hot water, for example when it is desired to produce hot water for domestic use (circulation of water in an open circuit), or for installations for heating water circulating in closed circuit (industrial heating, domestic heating, etc.).

More precisely, it relates to a novel type of boiler, the general structure of which employs heating means of the type of those described in WO-A-93 20389 for producing heat exchangers used in many industrial sectors (chemical industry, pharmaceutical industry, etc.), and which makes it possible to thermally regulate a fluid.

According to the teachings of the aforementioned document, such exchangers are in the form of an assembly comprising plates having, on both their faces, corrugations, for example herringbone corrugations, clamped together between two end walls by means of ties and which include, in their corners, openings which delimit, in the stack, inlet and outlet passages allowing circulation of fluids and which flow against the surface of said plates in the space lying between them. According to the teachings of this document, a heating plate, being in the form of a uniform block inside which a heater resistance element is embedded, the outside dimensions and the structure of the external faces of which block correspond to those of the elementary plates and which also includes, in its corners, orifices corresponding to those of said plates, may be inserted between two plates.

Now, it has been discovered, and it is this which forms the subject of the present invention, that it was possible to produce an actual electric boiler for heat-transfer liquid circulating in an open or closed circuit, which boiler may he easily adapted depending on the desired power for any type of installation by using such assemblies consisting of two stamped plates, the corrugations of which are in the same sense on both their faces and between which is inserted a heater block which is in the form of a uniform block, said assembly according to the invention being characterized in that:

the herringbone corrugations that the heater block has on both its faces are oriented in opposite senses;

the resistance element embedded in the central part of said heater block extending parallel to the active faces, electrical connections being arranged laterally.

Such an adaptation, according to which the herringbone corrugations or ribs of the two external faces of the heater block are opposingly oriented, contrary to the stamped elementary plates in which they are in the same sense, makes it possible to juxtapose several heater blocks and to obtain a standard channel for the circulation of the fluid while at the same time having electrical connections located on the same side of said plates, thus making the connection to an electrical box much simpler.

SUMMARY OF THE INVENTION

In accordance with the invention, in order to produce a boiler, the heater block will be in the form of a parallelepipedal assembly having a thickness markedly greater than the elementary plates, making it possible to incorporate a heater resistance element in its central part.

The heater block may include a single resistance element, but its structure also makes it possible to envisage incorporating into this heater block three electrical resistance elements connected to a three-phase source.

By way of indication, such a heated block will have a thickness of from fifteen to twenty millimeters, while the stamped elementary plates themselves, arranged on either side of said block, have an overall thickness of the order of three millimeters (distance between the corrugations on each face).

The heater block is made from any thermally conductive material, especially from materials such as metals (for example aluminum), graphite, plastics and composites.

Such a block is preferably obtained by molding, a shielded electrical resistance element being incorporated during this operation. Advantageously, the herringbone corrugations or ribs, as well as the peripheral groove on one of the faces for installing a seal, which components correspond to those of a stamped elementary plate of a plate exchanger, are advantageously produced during this molding operation, although it might be envisaged producing these subsequently by machining.

Finally, the two outside surfaces of said heater block may possibly receive a surface treatment depending on the nature of the liquid circulating against these walls. Such a treatment may be carried out by coating with, inter alia, polytetrafluoroethylene, chromium or nickel.

By virtue of such an assembly, it is therefore possible to produce hot water simply, for example for a heating installation or for domestic use (hot water), or even for steam generation.

BRIEF DESCRIPTION OF THE DRAWINGS

The invention and the advantages that it provides will, however, be easier to understand by virtue of the embodiment example which follows, given by way of indication but implying no limitation, and which is illustrated by the appended diagrams in which.

DESCRIPTION OF THE INVENTION

Referring to the appended diagrams, the boiler in accordance with the invention, which makes it possible to raise a heat-transfer liquid (FC), circulating in a circuit which can be open or closed, to a predetermined temperature, has the following structure.

Figure 1:
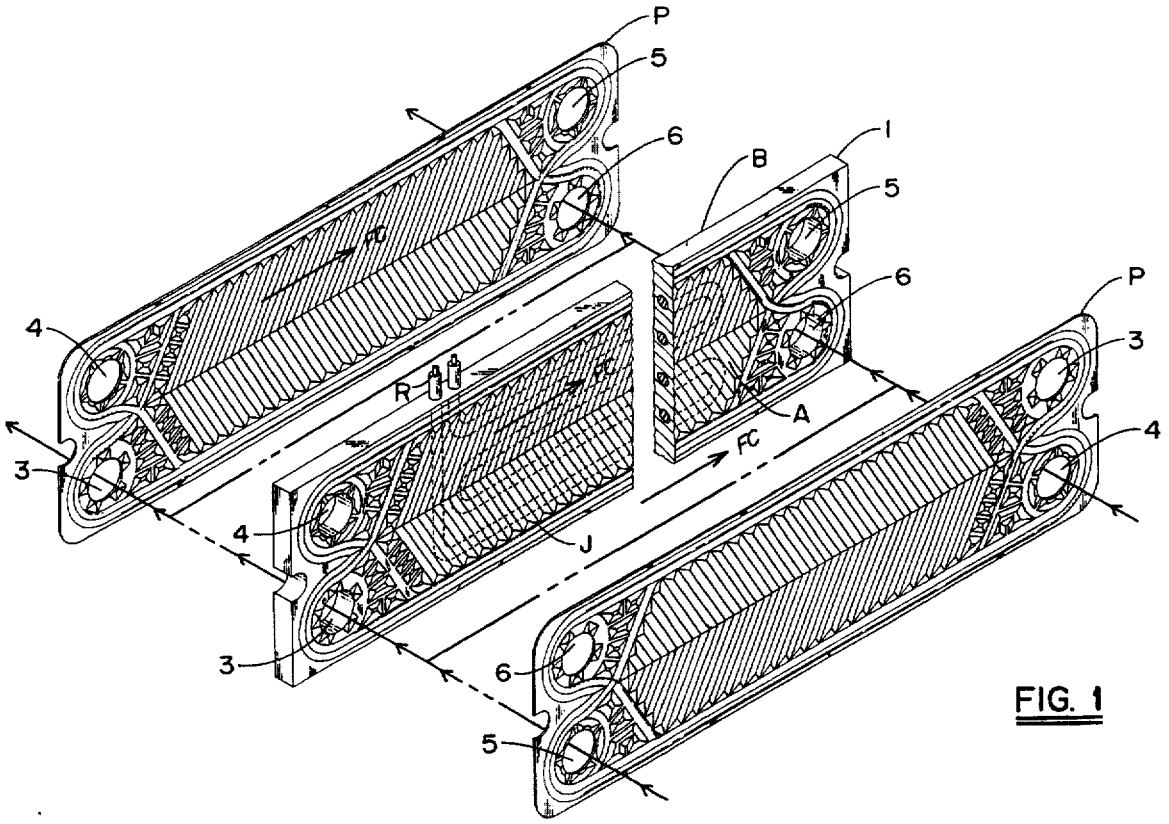
FIG. 1 is an exploded perspective diagrammatic view showing the general structure of the simplest shape of a boiler produced in accordance with the invention, the end walls and ties making it possible to combine the various elements involved in the production of such a boiler not being represented for reasons of simplification.

In its simplest embodiment, which appears in FIG. 1, this boiler is essentially composed of two stamped plates (P), having corrugations on both their faces, for example in the form of herringbones oriented in the same sense.

These plates (P) include, in their corners, openings which delimit, when they are stacked, inlet and outlet passages allowing circulation of a fluid, which circulation is obtained by means of a peripheral seal (J) associated with one of the faces of each plate (P).

Figures 2A, 2B, 3:
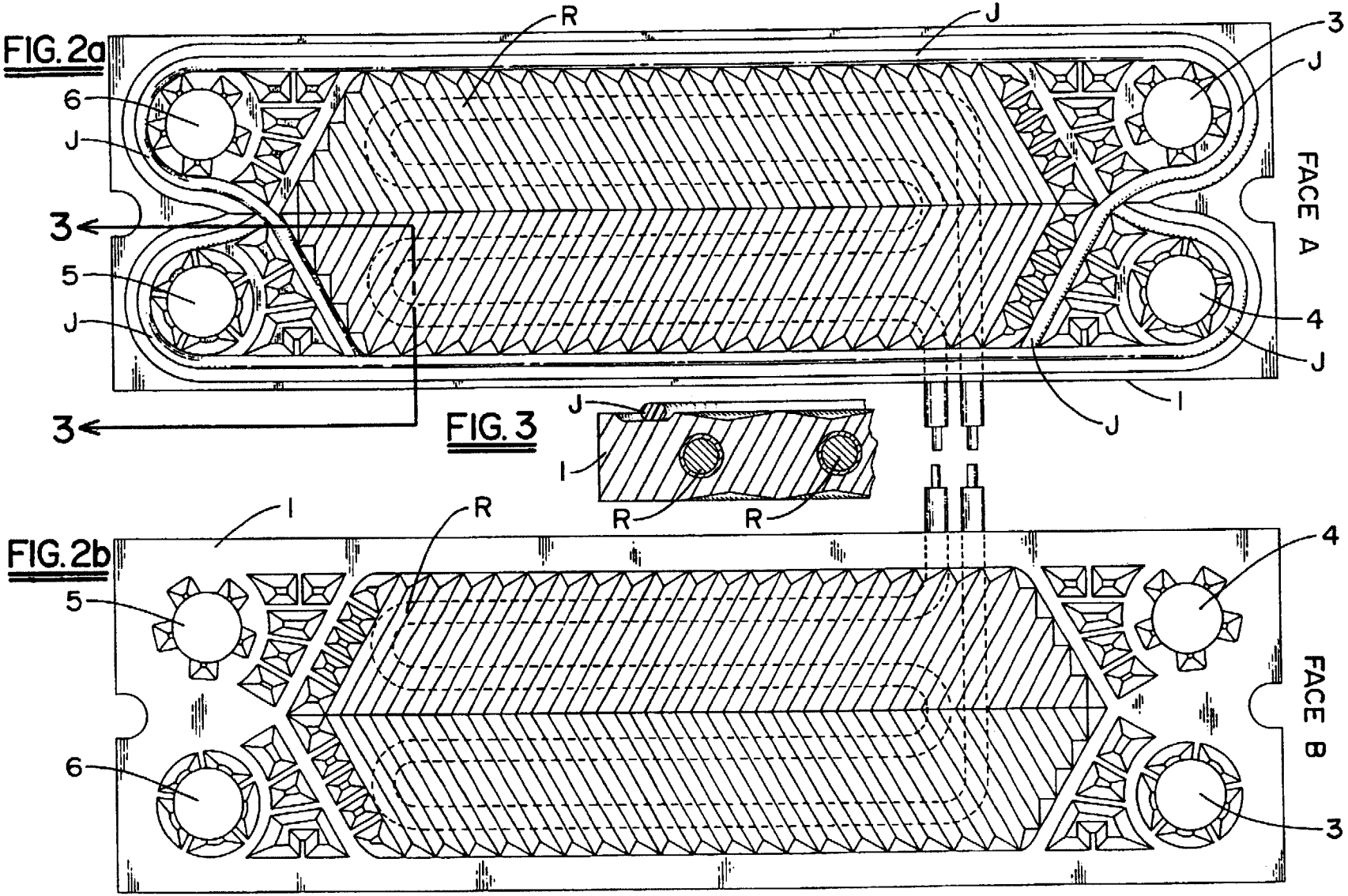
FIGS. 2A and 2B are elevation views of the two faces of the heater block in accordance with the invention involved in the production of such a boiler.
FIG. 3 is a detail view of the circle part in FIG. 2A, showing, in section, the structure of said heater block.

In accordance with the invention, inserted between two plates (P) is a heater block (I) which is in the form of a uniform block inside which an electrical resistance element (R) is embedded, in its central part (see FIGS. 2*a*, 2*b* and 3). This resistance element is of the shielded type and it is incorporated during the molding of the block (I), which block may be based on any conductive material, such as metal (aluminum), graphite, plastic, etc.

The outside dimensions of this block (I) as well as the structure of these external faces (A, B) correspond to those of the stamped elementary plates (P), except that the herringbone corrugations present on its external faces (A, B) are oriented in opposite senses, which has the advantage, as will be seen in the rest of the description, of being able possibly to juxtapose several heater blocks when it is desired to increase the power, while at the same time having electrical connections arranged on the same side as the plates.

Referring to FIG. 1, and by isolating the orifices (3, 4, 5, 6) of the elementary plates (P) and of the heater block (1), as illustrated in this figure, the liquid (FC) therefore flows against the surface of the heater block (I) in the channels formed by the cooperation of the corrugations that the faces of said block (I) have with those that the facing surfaces of the stamped plates (P) possess.

By way of example, it is possible to produce an electric boiler in accordance with the invention using two conventional stamped elementary plates (P) for the production of heat exchangers having a size of 350×102 and a thickness taken between crests of the corrugations of said plate of the order of three millimeters, by interposing, between two elementary plates (P), a heater block (I) having a thickness of fifteen millimeters in which is embedded a heater resistance element of the shielded type, having a diameter of approximately 6.5 mm and a power of 3000 watts/220 volts.

It should also be noted that the resistance element (R) has a configuration such that it extends into the central part of the heater block, within the surface defined by the peripheral seal (I).

Such a design makes it possible to produce, simply, boilers which are easy to assemble using components which may be produced in high volume.

Moreover, such a design also makes it possible to easily adapt the power of the boiler depending on the requirements. For example, since the power is directly proportional to the number of heater blocks, it is possible to increase it by juxtaposing a defined number of modules, as illustrated in FIG. 2 (two stamped plates, one heater block), the circulation of heat-transfer fluid always taking place between the heater blocks and the stamped plates.

Figure 4:
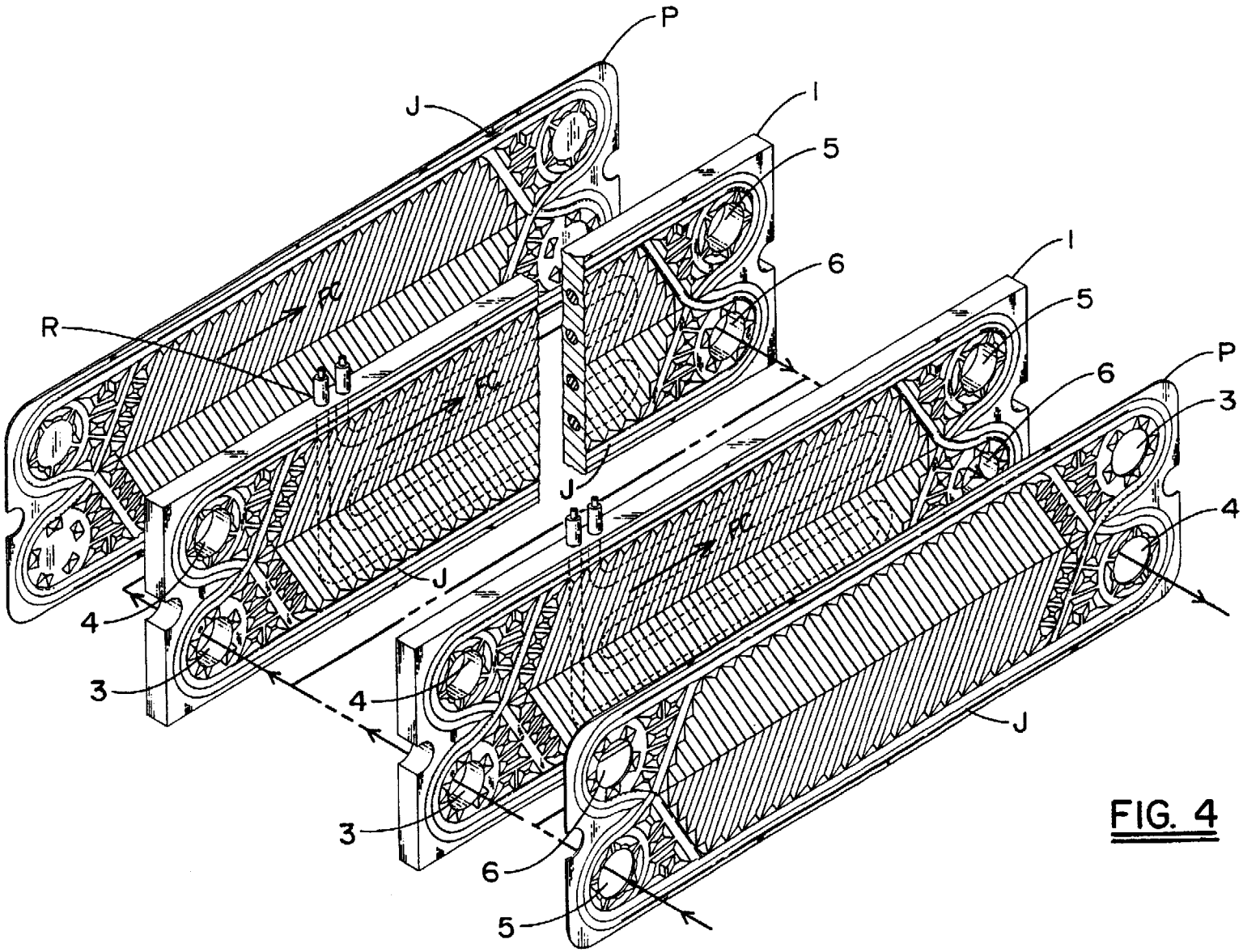
FIGS. 4 and 5 illustrate a variant of a boiler in accordance with the invention, including two juxtaposed heater blocks so as to increase the power, as well as the various types of fluid circulation that it is possible to obtain by virtue of such a boiler.
Figure 5:
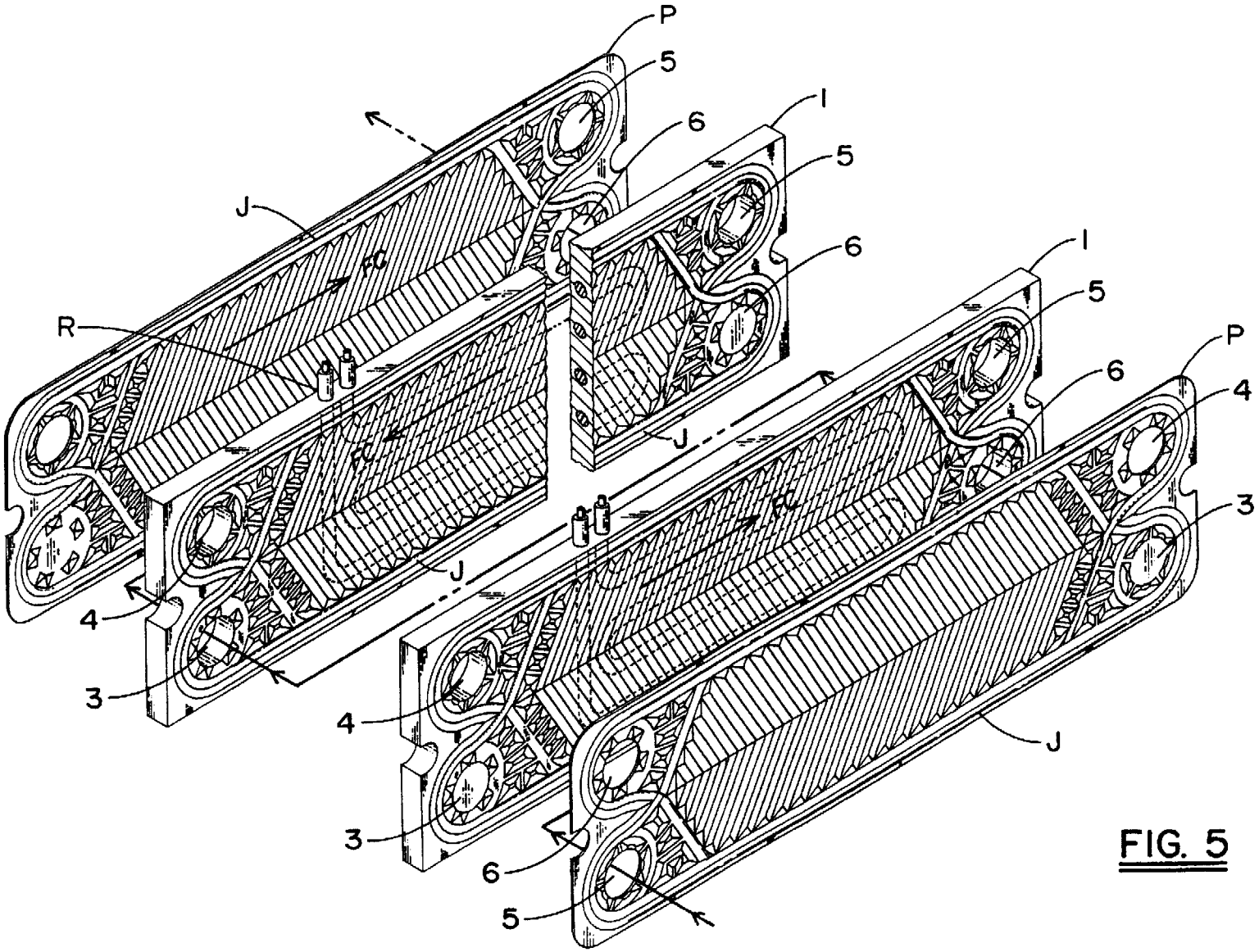

Another possibility for increasing the power of the boiler may consist, as is apparent in FIGS. 4 and 5, in juxtaposing several heating plates, the total power also being proportional to the number of heater blocks (I). In these FIGS. 4 and 5, the number of stamped elementary plates (P) is two, and grip between them two juxtaposed heater blocks (I). It is obvious that a boiler including a larger number of Juxtaposed heater blocks (I) could be produced.

It should also be noted that the design of a boiler in accordance with the invention makes it possible to adapt it very easily depending on the flow rate of heat-transfer fluid and on the temperature difference desired.

Thus, in the embodiment illustrated in FIG. 4, all the channels for the heat-transfer fluid are in parallel (one-pass circulation). Such an arrangement is particularly suitable when the flow rate of the heat-transfer fluid is high for a small temperature difference.

FIG. 5 illustrates the same type of boiler suitable for a low fluid flow rate with a large temperature difference, the circulation of the fluid then taking place in series (multipass circulation). To do this, all that is required is to close off alternately the openings (3) and (6) of the successive plates.

It might also be envisaged to produce a boiler combining a series/parallel circulation.

Over and above the high degree of flexibility offered by the design of a boiler in accordance with the invention, it should also be noted that the heat exchange between the heater block or blocks and the circulating liquid, is virtually perfect, uniform and without any hot spot, such that, for example, the temperature difference between the faces of said heater block is approximately only 2° C. for a 90° C. temperature.

Of course, the invention is not limited to the embodiment example described above, but it encompasses all variants thereof produced within the same spirit. Thus, it might be envisaged to have a heater block in which the corrugations on both faces (A, B) are oriented in the same sense, but then its electrical set up would be complicated.

We claim:

1. An electric boiler for a heat-transfer medium (FC), said medium characterized by one of a liquid and a fluid circulating in an open or closed circuit, said electric boiler being in the form of an assembly comprising plates (P) having, on both internal and external faces of said plates, corrugations, wherein said plates are clamped together between two end walls by ties, and which include, in corners of said plates, openings (3, 4, 5, 6) which delimit, when said plates are stacked, inlet and outlet passages allowing circulation of said medium which flows against a face of said plates in a space lying between said plates, and in a channel formed by said corrugations;

said assembly consisting of at least one module including two of said plates (P), the corrugations of which are in a congruent relationship on both their internal and external faces;

between said two plates (P) is inserted at least one heater block (I) which is in the form of a block inside which a heater resistance element (R) is embedded;

the outside dimensions and the structure of the external faces of said at least one heater block correspond to those of said plates (P);

said at least one heater block also including, in its corners, openings (3, 4, 5, 6) corresponding to those of said plates (P);

the corrugations that the at least one heater block (I) has on both its faces (A and B) are oriented in a non-congruent relationship;

the heater resistance element (R) embedded in the central part of the at least one heater block (I) extends parallel to said external faces of said at least one heater block, and having at least one electrical connection arranged on a first side of a surface of said at least one heater block between said external faces of said at least one heater block.

2. Electric boiler according to claim 1, wherein said at least one heater block comprises a plurality of juxtaposed heater block (I) inserted between two of said plates (P), the at least one electrical connection of each said heater block arranged on said first side.

3. Boiler according to claim 1 wherein the heater block (I) comprises a conductive material chosen from the group consisting of metals, composites, graphites, and plastics.

4. Boiler according to claim 1, wherein the heater block (I) is obtained by molding, the heater resistance element (R) being incorporated into said heater block during this operation.

5. Boiler according to claim 1, wherein said external faces of the heater block (I) include a coating.

6. Boiler according to claim 5, wherein the coating of the heater block (I) consists of a coating selected from the group consisting of polytetrafluoroethylene, chromium, and nickel.

* * * * *